United States Patent [19]

Ponce De Leon et al.

[11] Patent Number: 4,862,181

[45] Date of Patent: Aug. 29, 1989

[54] MINIATURE INTEGRAL ANTENNA-RADIO APPARATUS

[75] Inventors: Lorenzo A. Ponce De Leon, Lake Worth; Douglass K. Stamps, Jr., Boynton; Quirino Balzano, Plantation, all of Fla.

[73] Assignee: Motorola, Inc., Schaumburg, Ill.

[21] Appl. No.: 115,735

[22] Filed: Oct. 30, 1987

Related U.S. Application Data

[63] Continuation-in-part of Ser. No. 926,313, Oct. 31, 1986, abandoned.

[51] Int. Cl.[4] ..... H01Q 1/24; H01Q 7/00

[52] U.S. Cl. ..... 343/702; 343/855; 343/866

[58] Field of Search ..... 343/702, 728, 741, 742, 343/855, 859, 866

[56] References Cited

U.S. PATENT DOCUMENTS

| | | | |
|---|---|---|---|
| 2,910,695 | 10/1959 | Troost et al. | 343/855 |
| 3,427,624 | 2/1969 | Wanselow et al. | 343/752 |
| 3,550,137 | 12/1970 | Kuecker | 343/748 |
| 3,560,983 | 2/1971 | Willie et al. | 343/744 |
| 3,588,905 | 6/1971 | Dunlavey, Jr. | 343/856 |
| 3,761,933 | 9/1973 | Smalser | 343/740 |
| 4,123,756 | 10/1978 | Nagata et al. | 343/702 |
| 4,155,091 | 5/1979 | Vorie . | |
| 4,217,591 | 8/1980 | Czerwinski | 343/713 |
| 4,491,978 | 1/1985 | Nagata et al. | 343/742 |
| 4,518,965 | 5/1979 | Hidaka | 343/742 |
| 4,617,571 | 10/1986 | Choquer et al. | 343/744 |
| 4,625,212 | 11/1986 | Oda et al. | 343/702 |

FOREIGN PATENT DOCUMENTS

| | | | |
|---|---|---|---|
| 655205A | 8/1982 | Fed. Rep. of Germany . | |
| 3529914 | 3/1987 | Fed. Rep. of Germany . | |
| 0198902 | 11/1983 | Japan | 343/702 |
| 0030803 | 2/1986 | Japan . | |

OTHER PUBLICATIONS

"Down-to-earth Army Antenna", Electronics, vol. 40, No. 17, Aug. 21, 1967, p. 111, by Kenneth H. Patterson.

"Small, High-Efficiency Loop Antenna", QST, vol. LXX, No. 6, p. 33, by Ted Hart, W5QJR.

"The Army Loop in Ham Communication", QST, Mar. 1986, p. 17, by Lewis G. McCoy, WIICP.

"Miniloop HF Tunable Antenna 3.0-24 MHz Transmit-Receive", Antenna Research Associates, Inc.

"Small High Efficiency Antennas Alias The Loop", Ted Hart, W5QJR Antenna Products.

"Miscellaneous Antenna Types", Publication 36 of ARRL, Copyright 1978, Library of Congress Cat. #78-71955.

*Primary Examiner*—Rolf Hille

*Assistant Examiner*—Doris J. Johnson

*Attorney, Agent, or Firm*—Philip P. Macnak; Vincent B. Ingrassia

[57] ABSTRACT

An integral portable receiver/antenna system is provided which includes an isolation coupler element exhibiting a geometry which is substantially closed upon itself and which is situated between the receiver antenna and the input of the receiver. A portion of the antenna element is distributively coupled to a portion of the coupler element. The receiver/antenna system further includes a ground plane which is sufficiently close to a portion of the coupler element such that the ground plane is distributively coupled to the coupler element. The coupler element prevents the formation of undesired signal loss paths between the antenna and the receiver and provides for impedance matching the input of the receiver to the antenna. The coupler element also couples signals to the receiver input which would otherwise be lost to the ground plane.

14 Claims, 4 Drawing Sheets

–PRIOR ART–

–PRIOR ART–

MINIATURE INTEGRAL ANTENNA-RADIO APPARATUS

CROSS REFERENCE TO RELATED APPLICATIONS

This application is a continuation-in-part of copending U.S. Pat. application Ser. No. 926,313, filed Oct. 31, 1986, and now abandoned.

BACKGROUND OF THE INVENTION

This invention relates to antennas for radio frequency receivers and transmitters. More particularly, the invention relates to antennas and to the elimination of the undesired loss mechanisms which are typically associated with such antennas when coupled to a radio device.

In portable radio receivers such as paging receivers, the antenna is typically directly coupled to the first RF amplifier stage of the receiver via a coupling capacitor. An example of such an arrangement is illustrated in FIG. 1A which is a 3 schematic diagram found in U.S. Pat. No. 4,123,756, for a "Built-In Miniature Radio Antenna", issued to Nagata et al. The FIG. 1A schematic shows a loop antenna 10 directly coupled to an RF amplifier 20 via a coupling capacitor 30 therebetween. Unfortunately, at Ultra High Frequencies (UHF) and above, this structure has the disadvantage that various loss mechanisms act to reduce the efficiency of the antenna. For example, when the antenna is coupled to the receiver in this manner, alternative lossy paths exist between the antenna and receiver. One of the principal loss mechanisms is the undesired interaction of the antenna with other components on the receiver's printed circuit board, such as resonant circuits, shields and any conductors, for example. Thus signals are coupled from the antenna to the receiver circuits over paths other than the intended path through coupling capacitor 30. Unfortunately, the existence of these alternate lossy signal paths degrades antenna performance by lowering antenna efficiency. Moreover, antennas similar to the one just discussed are subject to self resonance when operation is attempted above UHF frequencies due to the loss mechanisms described above which prevail at these frequencies.

One approach which seeks to ameliorate the effects of these undesired signal paths is described in U.S. Pat. No. 4,491,978 for a "Portable Radio Receiver With High Gain Antenna", issued to Nagata et al. In that patent, Nagata et al. disclose an antenna 40 coupled to radio receiver circuits in the manner shown in the simplified schematic diagram of FIG. IB. That is, antenna 40 is coupled via a coupling capacitor 45 directly to the input of an RF amplifier 50 Amplifier 50 is coupled to a source of DC voltage via a high impedance circuit 55 and is coupled to ground via a high impedance circuit 56. The signal output of RF amplifier 50 is coupled to a mixer 60, the output of which is coupled to a high impedance circuit 57. Impedance circuits 55, 56 and 57 exhibit high impedances to the reception frequency, that is, the antenna circuit tuning frequency. In this manner, the Nagata et al. approach seeks to prevent undesired coupling between the antenna 40 and the receiver at the receive frequency by choking action. Unfortunately, with the Nagata et al. approach, only the receiver "back end" is decoupled from the antenna. That is, the RF amplifier, RF filter and RF mixer (receiver "front end") are still coupled to the antenna and subject to undesired loss mechanisms. The problem of undesired loss mechanisms between the antenna and portions of the receiver other than the receiver back end is not addressed by Nagata et al.

BRIEF SUMMARY OF THE INVENTION

One object of the present invention is to provide a portable radio receiver which prevents undesired loss mechanisms between an antenna and the remaining receiver circuits by isolating the antenna from all of the receiver circuits Another object of the present invention is to provide a portable radio receiver in which the antenna is prevented from self resonating so as to permit higher frequency operation.

Another object of the invention is to provide a portable radio receiver in which the antenna efficiency is increased.

Another object of the invention is to provide a portable radio receiver with increased packaging density.

In one embodiment of the invention, an integral portable receiver/antenna is provided which includes an antenna element which is geometrically configured to be substantially closed upon itself The antenna element includes first and second ends. First and second capacitors are coupled in series between the first and second ends of the antenna element. The first capacitor is variable to permit tuning of the antenna element. A coupler element is situated generally within the antenna element and is geometrically configured to be substantially closed upon itself. A portion of the coupler element is substantially parallel with, and sufficiently close to, a portion of the antenna element to permit distributed coupling between such portion of the antenna element and such portion of the coupler element. The coupler element includes an input end which is adapted to be coupled to a receiver. A ground plane is situated sufficiently close to a portion of the coupler element to permit distributed coupling between the ground plane and the coupler element.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1A:
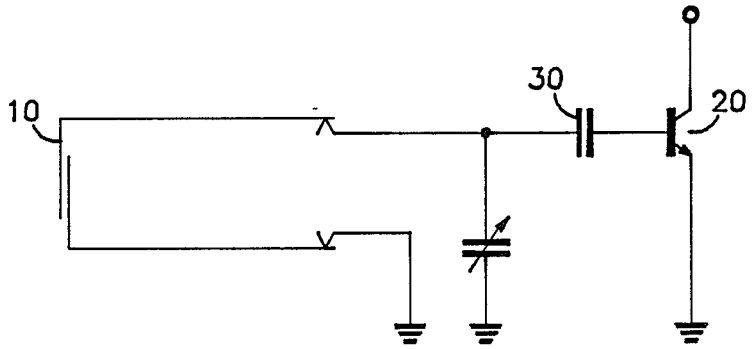
FIG. 1A is a schematic diagram of a conventional antenna coupled to an amplifier in a radio receiver.
Figure 1B:
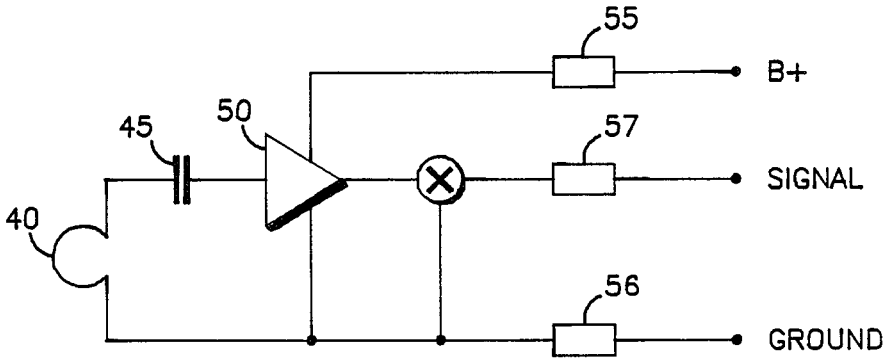
FIG. 1B is a simplified schematic diagram of a conventional antenna coupled to an amplifier in a radio receiver in which high impedance circuits are employed is stages subsequent to such amplifier.
Figure 2:
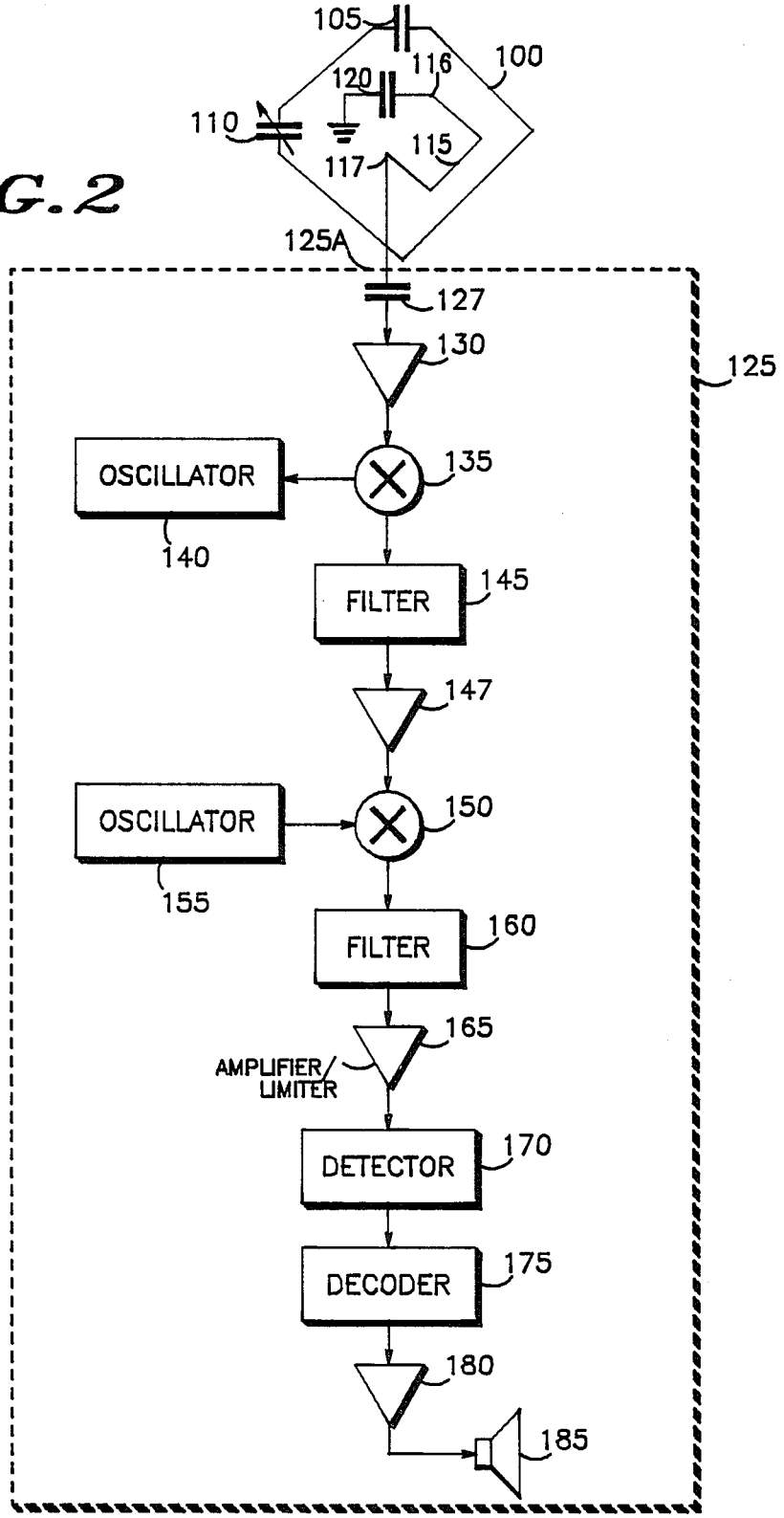
FIG. 2 is a schematic representation of the apparatus of the present invention.

Turning now to FIG. 2, one embodiment of the integral portable radio receiver/antenna is shown as including antenna element 100 which exhibits a geometry which closes upon itself, for example a substantially rectangular geometry, as described later in more detail. For purposes of this example, it will be assumed that the antenna is to be suitable for receiving radio frequency signals having a frequency within the range of 406 to 512 MHz and that any dimensions and values which are set forth herein are intended to permit the portable receiver/antenna to operate within that range. However, those skilled in the art will appreciate that these values and dimensions may be appropriately scaled up or down to permit operation of the portable receiver-/antenna at other frequencies.

A capacitor 105 is coupled in series with antenna element 100 as shown in FIG. 2. In this embodiment, capacitor 105 exhibits a capacitance of 8.2 pF. A variable capacitor 110 is also coupled in series with antenna element 100 and capacitor 105 as shown in FIG. 2. Variable capacitor 110 exhibits a capacitance which is variable between approximately 1 and 5 pF in this embodiment. The values of capacitors 105 and 110 are selected so that their combined capacitance permits antenna element 100 to resonate within the desired frequency range of operation and capacitance 110 is so adjusted.

An isolation/coupler element 115 is situated adjacent and sufficiently close to antenna element 100 to pickup radio signals impinging on element 100 by distributive action For example, one structure which is found to be suitable for isolation/coupler element 115 is a wire element having one turn which generally exhibits a geometry similar to that of antenna element 100 and which is situated generally within the space occupied by element 100. Sample geometries of elements 100 and 115 are discussed further in the example of FIG. 3A below.

As seen in FIG. 2, element 115 includes ends 116 and 117. Element end 116 is coupled via a capacitor 120 to ground. The value of capacitor 120 is 5 pF in this embodiment. The remaining element end 117 is coupled to a receiver 125 having a receiver input 125A. That is, element end 117 is coupled via a receiver input coupling capacitor 127 (5 pF in this example) to an RF amplifier 130. Amplifier 130 amplifies RF signals which impinge on antenna 100 and which are transferred to element 115 via transformer action.

The invention operates to substantially eliminate undesired loss mechanisms between an antenna and a wide variety of UHF and above receivers where loss mechanisms significantly reduce antenna efficiency. That is, in the present invention, distributed coupling is employed to couple receiver 125 to antenna element 100 via element 115 in a manner described in more detail subsequently. The receiver now discussed is an example of just one receiver where the invention is effective and this receiver example is discussed for sake of completeness. The invention is most advantageously employed with miniature paging receivers although other portable receivers also benefit from using the invention.

The output of amplifier 130, which is the first stage of a dual conversion receiver 125, is coupled to one of two inputs of a mixer 135, the remaining input of which is coupled to a local oscillator 140. RF signals at the output of mixer 135 are at the first intermediate frequency (IF). The output of mixer 135 is operatively coupled via filter 145 and IF amplifier 147 to a second mixer 150, the output frequency of which is controlled by an oscillator 155 coupled thereto. The output frequency of second mixer 150 is designated the second intermediate frequency (IF). The output of mixer 155 is coupled via filter 160 and amplifier/limiter 165 to a detector 170 which removes the audio signal component from the RF output signal of mixer 150. The output of detector 170 is coupled to the input of paging decoder 175 which analyzes the audio signal to determine if this particular pager receiver is being addressed. That is, the decoder 175 analyzes the detector output signal to determine if the receiver has received the pager receiver's unique address, which may be in the form of tone signals of different frequencies or in the form of unique digital signals. If the pager receiver has been addressed, then decoder 175 generates a signal output which is coupled via an amplifier 180 to an electroacoustic transducer 185 which alerts the pager receiver to the fact that such user has been paged. Those skilled in the art will appreciate that other receivers than the one described above by way of example may be advantageously employed in alternative embodiments of the invention where elimination of undesired loss paths between the antenna and the receiver is sought.

It is noted that there is no ohmic contact between antenna element 100 and receiver input 125A Or the subsequent circuits of receiver 125. As described subsequently in more detail in the description of FIG. 3A, a portion of element 115 forms a transmission line with a portion of element 100 to distributively (non-magnetically) couple elements 115 and 100 together. Thus, transmission line action through isolation coupling element 115 provides the path of least resistance (impedance) for signals from antenna element 100 to travel to receiver 125 and in this manner substantially eliminates the effects of any alternative lossy signal paths which the received signal might otherwise take between the antenna and the receiver. Isolation element 115 acts as a balun/impedance transformer which matches the impedance of amplifier 130 to the impedance of antenna element 100. At the same time it is noted that the balun action of isolation element 115 matches the unbalanced amplifier 130 to balanced antenna element 100.

For purposes of this document, distributed coupling refers to the type of electric field coupling observed when two conductors or elements form a transmission line and when the size of the two elements is a significant portion (more than approximately 10%) of a wavelength. Magnetic coupling refers to that type of magnetic field coupling observed when two conductors or elements are significantly smaller than 1 wavelength, that is less than approximately 1% of a wavelength).

Figure 3A:
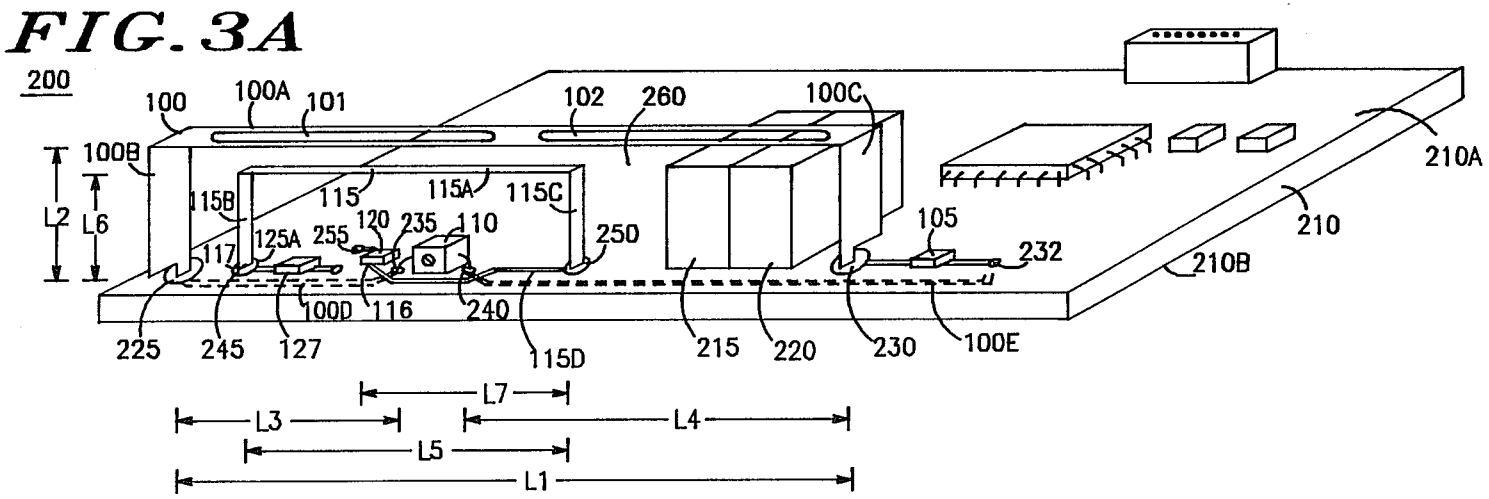
FIG. 3A is a perspective view of the integral receiver/antenna apparatus of the present invention.
Figure 4:
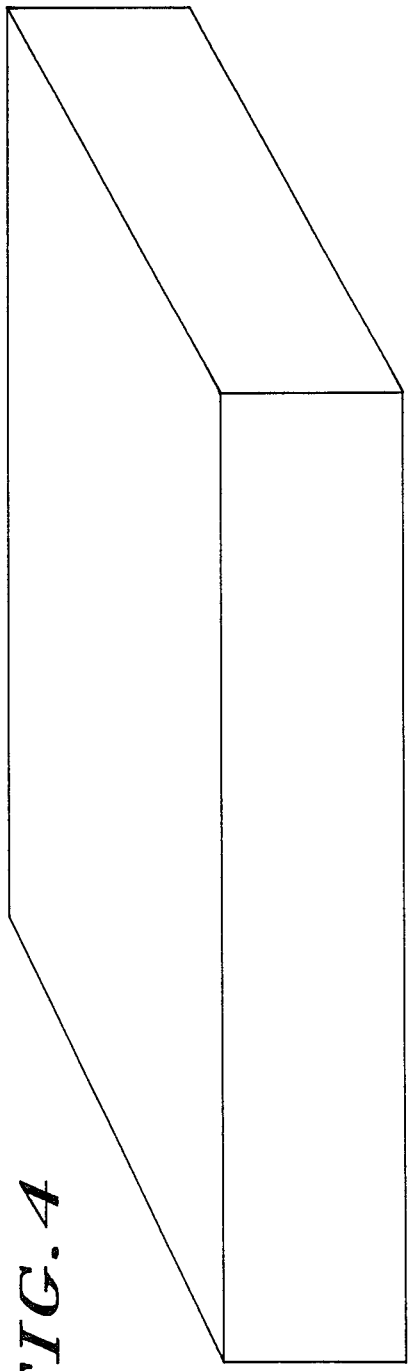
FIG. 4 is a graphic representation of a simplified housing for the present invention.

FIG. 3A shows one embodiment of the portable receiver/antenna of the present invention as integral receiver/antenna 200 in which the antenna portion is conveniently fabricated on an electrically insulative substrate such as printed circuit board 210 as shown. The opposed major surfaces of printed circuit board 210 are designated 210A and 210B, respectively. A substantial portion of substrate surface 210B is coated with electrically conductive material (not shown) to form a ground plane for antenna element 100 and coupler element 115. The components which comprise the receiver are located on circuit board 210. The antenna portion of the invention advantageously surrounds and encompasses several components of the receiver without suffering substantial performance degradation as do some antennas of the prior art when situated in close proximity to receiver components. For purposes of example, receiver components 215 and 220 are shown connected on circuit board 210 to illustrate that the antenna portion is suited to being located in close proximity to receiver components.

Antenna element 100 includes conductors 100A, 100B, 100C, 100D and 100E which together exhibit a substantially elongated rectangular shape. Antenna element 100 is geometrically configured such that element 100 substantially closes upon itself such as shown in FIG. 3A. The portion of antenna element 100 which includes conductors 100A, 100B and 100C is situated above the surface 210A side of circuit board 210 while conductors 100D and 100E are situated on lower surface 210B of the circuit board as indicated by dashed lines in FIG. 3A. Conductors 100A, 100B and 100C geometrically resemble an inverted U and are conveniently fabricated from flat ribbon conductor. For example, tin plated copper ribbon conductor which is approximately 10 mils thick and $\frac{1}{8}$ inch wide is one conductor material which has been found to be suitable. Conductor 100A exhibits a length L1 equal to approximately 1.8 inches. Conductor 100A is oriented substantially parallel to circuit board 210 and is situated approximately 0.35 inches therefrom. The opposed ends of conductor 100A are coupled to ends of conductors 100B and 100C which together support conductor 100A above printed circuit board 210. Conductors 100B and 100C each exhibit a length L2 which is equal to approximately 0.35 inches. Conductor 100A includes slots 101 and 102 which are longitudinally situated within conductor 100A along the longer dimension of conductor 100A as shown in FIG. 3A. Slots 101 and 102 act to reduce the capacitance between antenna element 100 and isolation coupler element 115.

The remaining ends of conductors 100B and 100C are connected to conductive circuit board pads 225 and 230. These remaining ends of conductors 100B and 100C are connected via through the board connections to respective ends of conductors 100D and 100E, which are situated on the opposite side 210B of circuit board 210 as shown in FIG. 3A. Conductors 100D and 100E are drawn in dashed lines to indicate that they are located on circuit board surface 210B which is hidden from view in FIG. 3A. More specifically, conductor 100B is connected to conductor 100D via a through the board connection located at pad 225. Conductor 100C is connected to one end of conductor 100E via capacitor 105 and a through the board connection 232. Conductor 100D exhibits an length L3 which is approximately equal to 0.5 inches. Conductor 100E exhibits a length L4 which is approximately equal to 1.2 inches.

The remaining end of conductor 100D is coupled via a through the board connection 235 to variable capacitor 110. The remaining end of conductor 100E is coupled via a through the board connection 240 to variable capacitor 110.

Antenna isolation/coupling element 115 includes conductors 115A, 115B, 115C, 115D and 115E. The geometry of element 115 is substantially similar to the geometry of antenna element 100 in that element 115 substantially closes upon itself as shown in FIG. 3A. In the example of FIG. 3A, element 115 is situated substantially within antenna element 100. That is, element 115 is in a plane substantially parallel to the plane of antenna element 100.

Conductor 115A is situated between and parallel to conductor 100A and printed circuit board surface 210A. Conductor 115A exhibits a length L5 of approximately 1 inch and is located within close proximity of conductor 100A, typically within approximately 0.05 inches therefrom. One end of conductor 115A is coupled to one end of conductor 115B, while the remaining end of conductor 115A is coupled to one end of conductor 115C. Conductors 115B and 115C each exhibit a length L6 of approximately 0.30 inches and are oriented substantially perpendicular to circuit board surface 210A. The remaining ends of conductors 115B and 115C are connected to circuit board pads 245 and 250, respectively, as shown in FIG. 3A.

The remaining end of conductor 100B, namely antenna element end 117, is coupled to capacitor 127 which constitutes the input of the receiver portion of the antenna/receiver structure. The remaining end of conductor 115C is coupled to a conductor 115D which extends from pad 250 to conductor end 116 which is situated adjacent capacitor 127. Conductor end 116 is coupled to one terminal of capacitor 120 as shown in FIG. 3A. The remaining terminal is coupled to ground at connection point 255.

A transmission line is formed by antenna element 100 and coupler element 115 at the portion of element 115 defined by conductors 115A, 115B, 115D and 115E and the portion of antenna element 100 adjacent conductors 115A, 115B, 115D and 115E. Coupler conductors 115A, 115B, 115D and 115E are sufficiently close to antenna conductors 100A, 100B, 100E and 100D, respectively, such that the aforementioned transmission line is effectively formed therebetween. Stated alternatively, coupler conductors 115A, 115B, 115D and 115E are spaced sufficiently close to antenna conductors 100A, 100B, 100E and 100D, respectively, such that coupler conductors 115A, 115B, 115D and 115E are distributively coupled to antenna conductors 100A, 100B, 100E and 100D respectively.

For example, in the embodiment of the invention shown in FIG. 3A, it has been found that a spacing of approximately 0.5 inches between coupler conductor 115A and antenna conductor 100A and a similar spacing between the remaining conductor pairs 115B-100B, 115D-100E, and 115E-100D is sufficiently small to cause such distributed coupling. It is noted that in this embodiment, coupler conductor 115A is substantially parallel with antenna conductor 100A and coupler conductor 115B is substantially parallel with antenna conductor 100B. Likewise conductor 115D is substantially parallel with conductor 100E and conductor 115E is parallel with conductor 100D. The unique geometrical arrangement described above results in a receiver/antenna 200 in which distributed coupling is the main mode of coupling between antenna element 100 and receiver 125. The amount of magnetic coupling between antenna element 100 and receiver 125 is insignificant due to the arrangement of the antenna element 100/coupler element 115 structure described above.

A component receiving chamber 260 is formed within the antenna portion of the receiver/antenna structure of the invention. Chamber 260 is bounded by conductor 115C and conductor 100C which constitute the sides thereof. Chamber 260 is further bounded by conductor 100A and circuit board surface 210A which constitute the upper and lower surface thereof. Component receiving chamber 260 is an important feature of the invention, in that the antenna portion of the invention is so designed that electrical receiver or other components are placed within 260 without significant degradation of receiver/antenna performance. In this manner, the packaging density of the receiver/antenna structure of the invention is significantly increased since receiver components can actually be located within the space occupied by the antenna.

Figure 3B:
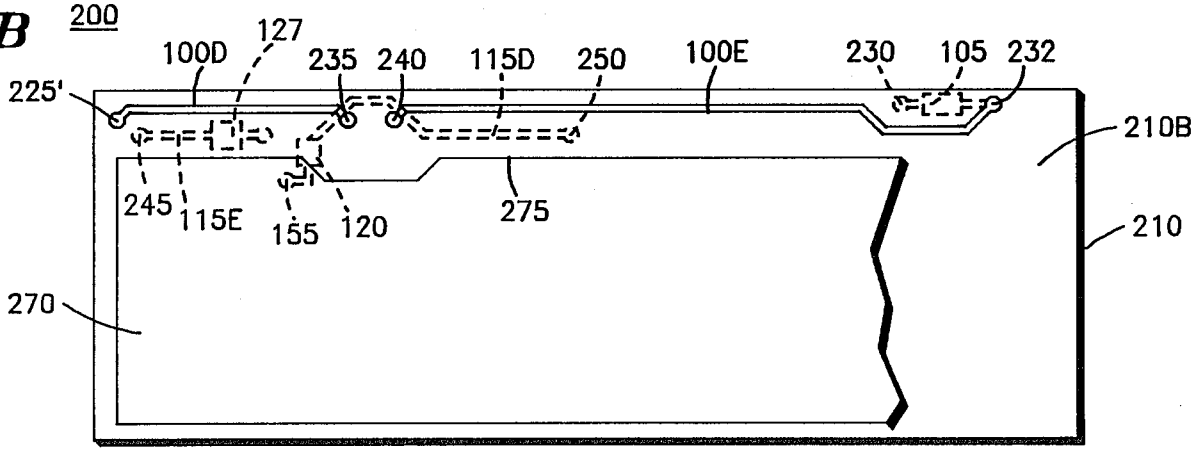
FIG. 3B is a bottom view of the apparatus of FIG. 3A.

FIG. 3B is a bottom view of integral receiver/antenna structure 200. A substantial portion of bottom substrate surface 210B is metallized to form a groundplane 270. Electrically conductive paths or runners (not shown) may be interspersed within groundplane 270 and remaining portions of surface 210B to facilitate interconnection of electrical circuit elements on surface 210A. Coupler conductors 115D and 115E are located sufficiently close to groundplane 270 such that conductors 115D and 115E are distributively coupled to groundplane 270. In this manner, signals potentials which appear in groundplane 270 due to signals impinging thereon, and which would otherwise be lost, are coupled via coupler element 115 to a receiver connected to input coupling capacitor 127. In this particular example, ground plane 270 includes an edge surface 275 which is substantially parallel with coupler conductors 115D and 115E.

It is noted that the structure of the invention is particulary useful at UHF frequencies and above where loading effects between the antenna and the radio generally substantially degrade antenna efficiency and performance. Loss mechanisms between the antenna and the entire receiver are eliminated or substantially reduced at these frequencies.

The structure of the invention provides essentially the lowest possible impedance path between the antenna and the receiver, and in this manner increases the effective gain of the antenna. That is, current flow between the antenna and the receiver is maximized thereby increasing antenna performance.

Those skilled in the art will also appreciate that the specific geometry shown in the drawing of FIG. 3A is given by way of example and that the geometry of the antenna may be altered to fit other form factors as long as the schematic diagram of FIG. 2 is generally followed. Advantageously, the receiver/antenna of the invention permits receiver components such as components 215 and 220 to be situated within the space occupied by the antenna portion thereof without substantial degradation of antenna performance. Increased packaging density is obtained in this manner.

Figure 5:
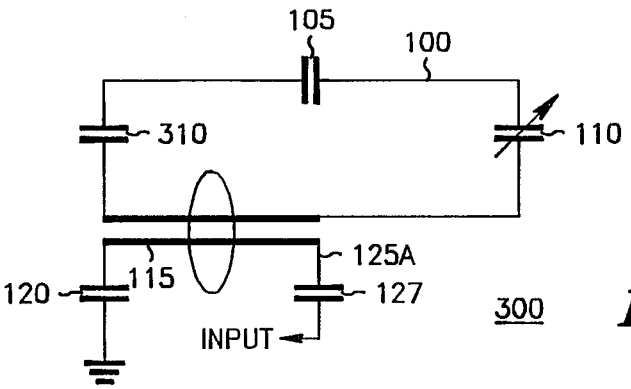
FIG. 5 is a schematic representation of another embodiment of the present invention.

As mentioned above, the antenna of receiver/antenna structure 200 may be scaled to operate at frequencies other than those given in the foregoing example. FIG. 5 shows a schematic diagram of antenna 300 which is similar to the antenna of FIG. 2 and 3A except for the modifications discussed below. Antenna 300 includes a capacitor 310 in series with capacitors 105 and 110 as seen in FIG. 5 to facilitate operation in the 900 MHz band, for example at approximately 930 MHz. Capacitor 310 is typically mounted on bottom substrate surface 210B in series with conductor 100E of FIG. 3A. A typical value of capacitance for capacitor 310 is approximately 2 pF.

To schematically describe the distributed coupling between antenna element 100 and coupler element 115, a portion of antenna element 100 and a portion of coupling element have been drawn parallel with each other in the fashion of a transmission line. An ellipse is used to denote the distributed coupling between these elements.

The foregoing describes an integral portable receiver/antenna in which the antenna portion is prevented from self resonating so as to permit higher frequency operation. Moreover antenna efficiency is increased while substantially reducing undesired loss mechanisms between the antenna and the remainder of the receiver circuits.

While only certain preferred features of the invention have been shown by way of illustration, many modifications and changes will occur to those skilled in the art. It is, therefore, to be understood that the present claims are intended to cover all such modifications and changes which fall within the true spirit of the invention.

We claim:

1. An antenna comprising:

a ground plane;

an antenna element isolated from said ground plane and is geometrically configured to be substantially closed upon itself, said antenna element including first and second ends;

at least one capacitor coupled in series between the first and second ends of said antenna element, said capacitor being variable to permit tuning of said antenna element at an operating frequency; and a coupler element, situated generally within said antenna element, a portion of said coupler element being substantially parallel with, and sufficiently close to, a portion of said antenna element to permit distributed coupling between said portion of said antenna element and said portion of said coupler element, said coupler element including an input end which is adapted to be coupled to a receiver, and a terminating end coupled to said ground plane through a second capacitor.

2. The antenna of claim 1 wherein said antenna element exhibits a substantially rectangular geometry.

3. The antenna of claim 1 wherein said coupler element exhibits a substantially rectangular geometry and said portion of said coupler element being substantially parallel to a portion of said antenna element includes at least one side of said coupler element being substantially parallel to a portion of one side of said antenna element.

4. The antenna according to claim 1 wherein said isolated antenna element provides a balanced signal output.

5. The antenna according to claim 1 wherein said input end of said coupler element is adapted to couple to an unbalanced input.

6. The antenna according to claim 1 wherein said coupler element further having an additional side situated sufficiently close to said ground plane to further permit distributed coupling between said additional side and said ground plane.

7. The antenna of claim 1 wherein said second capacitor for resonating said coupler element at a self resonant frequency substantially higher than the operating frequency of the antenna.

8. An integral portable receiver/antenna comprising:

a portable receiver housing;

a substrate situated within said housing, said substrate including first and second major opposed surfaces, and further including a ground plane situated on one of said surfaces;

antenna means, situated on said substrate and isolated from said ground plane, for capturing radio frequency signals at an operating frequency impinging thereon;

receiver means, situated on said substrate, for receiving radio frequency signals at the operating frequency, said receiver means including an input; and isolation coupler means, coupled between said antenna means and the input of said receiver means, for coupling radio frequency signals from said antenna means to the input of said receiver means and for preventing the formation of signal paths between said antenna means and portions of said receiver means other than the input of said receiver means, said isolation coupler means being self resonant at a frequency substantially higher than the operating frequency and including a transmission line portion which is distributively coupled to said antenna means.

9. The receiver/antenna of claim 4 wherein said antenna means includes receiver component chamber means, situated within the space occupied by said antenna means, for containing receiver components therein.

10. The receiver/antenna of claim 4 wherein said antenna means includes slot means for reducing the capacitance between said antenna means and said isolation coupler means.

11. The receiver/antenna according to claim 8 wherein said isolated antenna means provides a balanced signal output.

12. The receiver/antenna according to claim 8 wherein said input of said receiver means is an unbalanced input.

13. The receiver/antenna according to claim 8 wherein an additional portion of said isolation coupler means being situated sufficiently close to the ground plane to additionally permit distributed coupling thereto.

14. The receiver/antenna according to claim 13 wherein said additional portion of said isolation coupler means which couples to said ground plane further couples to said antenna means.

* * * * *